United States Patent [19]

Sammells et al.

[11] Patent Number: 4,804,448

[45] Date of Patent: Feb. 14, 1989

[54] APPARATUS FOR SIMULTANEOUS GENERATION OF ALKALI METAL SPECIES AND OXYGEN GAS

[75] Inventors: Anthony F. Sammells; Krystyna W. Semkow, both of Naperville, Ill.

[73] Assignee: Eltron Research, Inc., Aurora, Ill.

[21] Appl. No.: 65,962

[22] Filed: Jun. 24, 1987

[51] Int. Cl.[4] ..... C25C 3/02; C25C 3/18; C25C 7/00

[52] U.S. Cl. ..... 204/243 R; 204/68; 204/245; 204/247; 204/290 R; 204/291; 204/292; 204/293; 204/294; 204/295; 204/252

[58] Field of Search ..... 204/68, 129, 243 R, 204/244–247, 252, 237, 282, 61, 290 R, 291–295

[56] References Cited

U.S. PATENT DOCUMENTS

| | | | |
|---|---|---|---|
| 3,440,153 | 4/1969 | Arnoldi et al. | 204/61 X |
| 3,488,271 | 1/1970 | Kummer et al. | 204/68 X |
| 3,562,135 | 2/1971 | Marincek | 204/247 X |
| 3,578,580 | 5/1971 | Schmidt-Hatting et al. | 204/247 X |
| 3,607,684 | 9/1971 | Kuhn | 204/68 X |
| 4,089,770 | 5/1978 | Lemke | 204/68 X |
| 4,405,416 | 9/1983 | Raistrick et al. | 204/68 |
| 4,455,202 | 6/1984 | Sintim-Damoa et al. | 204/68 |

OTHER PUBLICATIONS

R. D. Waldron and D. R. Criswell, "Overview of Methods for Extraterrestrial Materials Processing", Fourth Princeton Conference on Space Manufacturing Facilities, Report 79-1379, Princeton N.J. 1979.

L. A. Haskin and J. Lindstrom, "Electrochemistry of Lunar Rocks", Fourth Princeton/AIAA Conference on Space Manufacturing Facilities, Report 79-1380, Princeton, N.J., 1979.

K. W. Semkow and L. A. Haskin, "Concentrations on Behavior of Oxygen and oxide ion in melts of composition $CaO.MgO.xSiO_2$", Geochimica et Cosmochimica Acta vol. 49, p. 1897 (1985).

K. W. Semkow, R. A. Rizzo, L. A. Haskin and D. J. Lindstrom, "An Electrochemical Study of $Ni^{2+}$, $Co^{2+}$, and $Zn^{2+}$ ions in melts of composition $CaMgSi_2O_6$", Geochimica et Cosmochimica Acta vol. 46, p. 1879 (1982).

K. W. Semkow and L. A. Haskin, "Oxidation of Platinum Anodes in Silicate Melt Electrolysis", Abstracts of Lunar Plant Sci., XVI, p. 761 (1985).

A. Ghosh and T. B. King, "Kinetics of Oxygen Evolution at a Platinum Anode in Lithium Silicate Melts", Transactions of the Metallurigical Society of AIME, vol. 245, p. 145 (1969).

J. K. Higgins, "Anodic Polarization at Platinum Electrodes in Molten Silicate Glass", Glass Technology, vol. 23, p. 90 (1982).

*Primary Examiner*—Donald R. Valentine

*Attorney, Agent, or Firm*—Thomas W. Speckman; Ann W. Speckman

[57] ABSTRACT

A process and apparatus for electrochemically separating alkali oxides to simultaneously generate oxygen gas and liquid alkali metals in a high temperature electrolytic cell is provided. The high temperature electrolytic cell comprises a cathode in contact with an alkali ion conducting molten salt electrolyte separated from the anode by an oxygen vacancy conducting solid electrolyte. Alkali metals separated in the alkali metal reducing half cell reaction are useful as reducing agents in the direct thermochemical refining of lunar metal oxide ores to produce metallic species and alkali oxides, and the alkali oxides may then be recycled to the high temperature electrolytic cell.

18 Claims, 1 Drawing Sheet

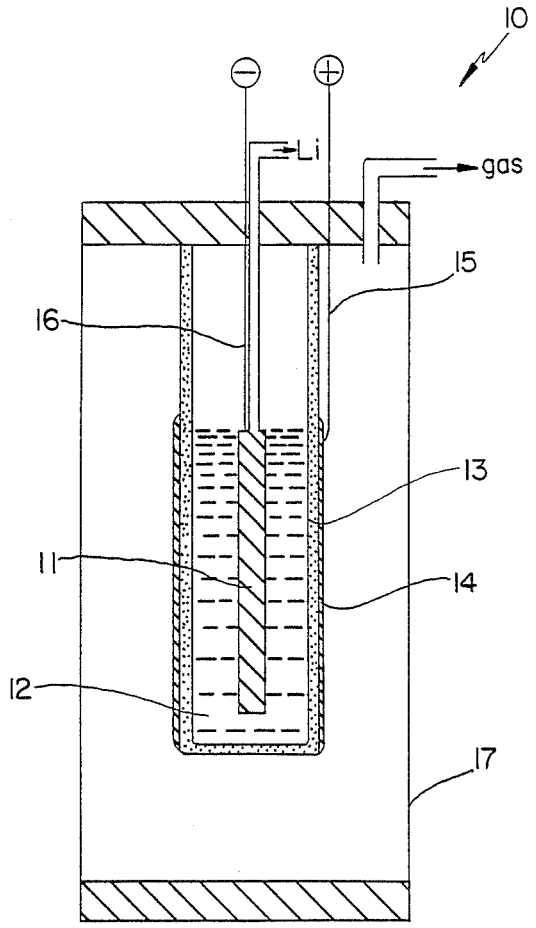
10
Li
gas
15
16
13
11
14
12
17

APPARATUS FOR SIMULTANEOUS GENERATION OF ALKALI METAL SPECIES AND OXYGEN GAS

This invention was made as a result of work under Lyndon B. Johnson Space Center Contract NO. NAS 9-17743 awarded by the National Aeronautics and Space Administration. The government has certain rights in this invention.

BACKGROUND OF THE INVENTION

1. Field of the Invention

Development of a permanent base on the Moon's surface may lead to human and animal colonization, which will require a plentiful supply of both oxygen gas for respiration and refined metals for structural materials. New technical strategies must be developed for the generation of useful chemical species from lunar materials directly on the Moon's surface due to the prohibitive costs associated with the transportation of necessary materials from Earth.

The present invention relates to a process and apparatus for electrochemical separation of alkali oxides to simultaneously generate oxygen gas and liquid alkali metals in a high temperature electrolytic cell. The process and apparatus of the present invention would be particularly applicable under lunar conditions and liquid alkali metal removed from the electrolytic cell may be utilized in the direct thermochemical refining of lunar metal oxide ores. A preferred process system of the present invention provides electrochemical separation of $Li_2O$ in a high temperature electrolytic cell to simultaneously generate liquid lithium and oxygen gas, followed by the chemical oxidation of liquid lithium by reaction with lunar metal oxide ores producing reduced metal species and $Li_2O$ which may be recycled to the high temperature electrolytic cell.

2. Description of the Prior Art

Analysis of lunar soils and rocks collected during the Apollo program has demonstrated the presence of pyroxene type minerals (iron magnesium calcium silicates), plagioclase feldspars (calcium aluminum silicates), ilmenite (iron titanium oxides), and iron-nickel alloys. Based upon examination of the random samples returned to Earth during the Apollo program, the principal elements contained in such lunar "ores" appear to be oxygen, silicon, aluminum, calcium, iron, magnesium, titanium and nickel.

Some researchers have suggested that oxygen gas may be extracted from ilmenite ($FeTiO_3$) via an initial chemical reduction using hydrogen transported from Earth as a reducing agent. Other researchers have proposed carbothermic reduction of lunar metal ores to separate the desired metal species.

Characterization of the high temperature electrochemistry of simulated lunar materials has been performed using metal silicate melts and platinum electrodes. High temperature electrolysis of metal silicates results in the simultaneous evolution of oxygen gas at the anode and deposition of a reduced metal silicon alloy slag at the cathode. Although the potential for using high temperature molten salt electrochemical techniques to separate oxygen gas and reduced metal species from simulated lunar materials comprising alkali oxides has been demonstrated, several technical limitations have been encountered. High temperature molten salt cells operating at temperatures in excess of about 1300° C. experience chemical and electrochemical materials degradation which limits the cell efficiency and overall cell lifetime. Oxygen generated at the anode of a molten silicate ($CaMgSi_2O_6$ containing $Fe^{3+}$, $Co^{2+}$, or $Ni^{2+}$) electrolytic cell has a tendency to become trapped within the molten salt electrolyte, creating a foam in the proximity of the anode. This not only prevents efficient removal of oxygen gas from the cell, but it renders the oxygen gas more susceptible to electrochemical reduction at the cathode. Deposition of the reduced metal or metal silicate species at the cathode may result in dendrite formation and eventually produce inter-electrode short circuiting of the cell. Furthermore, continuous removal of reduced solid metallic species from the cathode is not practical in known cells, and the process would be limited to a batch-type operation.

SUMMARY OF THE INVENTION

It is an object of the present invention to provide a process and apparatus for separating alkali oxides to produce oxygen gas and liquid alkali metal species in a high temperature electrolytic cell.

It is another object of the present invention to provide an electrochemical process and apparatus for simultaneously separating oxygen gas and reduced metal species from simulated lunar materials comprising alkali oxides.

It is still another object of the present invention to provide a continuous source of liquid alkali reducing agent for use in direct thermochemical refining of lunar metal oxide ores to produce reduced metallic species and alkali oxides which may be recycled directly for use in the high temperature electrolytic cell.

It is yet another object of the present invention to provide separation of $Li_2O$ in a high temperature electrochemical cell whereby liquid lithium is deposited at and may be continuously removed from the cathode and oxygen gas is generated at the anode, and an oxygen vacancy conducting solid electrolyte effectively separates the oxygen generating and alkali metal reducing half-cell reactions.

It is yet another object of the present invention to provide an electrolytic cell configuration which permits continuous removal of liquid alkali species from the cathode compartment and is operable at generally lower temperatures to reduce chemical and electrochemical materials degradation problems and prolong the overall cell lifetime.

The high temperature electrolytic cell of the present invention comprises a cathode in contact with an alkali metal ion conducting molten salt electrolyte for achieving the alkali metal half-cell reduction reaction. The molten salt electrolyte is contained and the half-cell reactions are separated by an oxygen vacancy conducting solid electrolyte in contact with the anode, where oxygen gas evolution occurs. During operation of the high temperature electrolytic cell, electrochemical separation of alkali oxides, such as $Li_2O$ in the molten salt electrolyte produces liquid alkali metal, such as lithium which is deposited at the cathode/molten salt electrolyte interface and $O^{-2}$ ions which are transported through the oxygen vacancy conducting solid electrolyte to the anode, where oxygen gas is evolved. The overall cell reaction is: $M_2O \rightarrow > 2M + \frac{1}{2}O_2$, where M is an alkali metal species, with the cathodic half cell reaction: $2M^+ + 2e^- \rightarrow > 2M$; and the anodic half cell reaction: $O^{-2} \rightarrow > 1/2O_2 + 2e^{31}$ . Lithium and sodium are preferred alkali metals for use in this invention, and lithium is especially preferred. Where lithium and lithium compounds are referred to in the following discussion, it should be recognized that other alkali metals may be used in the practice of the present invention along with suitable alkali metal ion conducting molten salt electrolytes.

The simulated lunar molten salt diopside $CaMgSi_2O_6$ has a melting point of about 1390° C., which is undesirably high for most electrolytic cell applications. Addition of $K_2O$, as $K_2SiO_3$, however, reduces the melting point to useful ranges, and addition of $Li_2O$ increases the ionic conductivity. Other alkali oxide, and particularly $Li_2O$ containing binary or ternary molten salt electrolytes having high alkali ion conductivity and having a melting point below about 1000° C. are also suitable. The cathode preferably comprises a low carbon steel, stainless steel, silicon or iron silicides ($FeSi_2$). Lithium deposition at iron silicide cathodes during cell operation is facilitated by the formation of lithiated compounds, including lithiated ferrous silicides on the surface of the cathode. Experimental research indicates that a series of lithiated compounds including $SiLi_2$, $SiLi_3$, $SiLi_4$, and $SiLi_5$, and lithiated ferrous silicides, including $FeSi_2Li_4$, $FeSi_2Li_6$, $FeSi_2Li_8$, and $FeSi_2Li_{10}$ may be formed at the cathode to produce a uniform coating of $FeSi_2Li_{10}$ which has an equilibrium potential about 50 mV positive of unit activity lithium. Passage of further current through the cell results in deposition of molten unit activity lithium at the cathode interface with the molten salt electrolyte. Molten lithium may be continuously removed from the cathode compartment.

According to the present invention, the alkali ion conducting molten salt electrolyte is contained and separated from the oxygen electrode by an oxygen vacancy conducting solid electrolyte. Suitable solid electrolytes, such as zirconia ($ZrO_2$) stabilized by the introduction of lower valence metal ions, provide high $O^{-2}$ conductivity at the high operating temperatures of the electrolytic cell. Suitable oxygen evolving anode materials must be stable in the strongly oxidizing anodic environment and at high temperatures and provide effective electronic conduction. Electrodes comprising perovskite-type compounds and similar materials are suitable for use with the present invention. Suitable current collectors may also be provided, as is known in the art.

The high temperature electrolytic cell of the present invention is preferably operated at substantially atmospheric pressures under sealed conditions to avoid vaporization losses. Suitable operating temperatures for the electrolytic cell depend upon the melting point of the molten salt electrolyte and the molten alkali metal being deposited at the surface of the cathode. Utilization of the disclosed high temperature electrochemical techniques on the Moon is viable, since DC power may be provided by solid-state photovoltaic power sources which are known to the art, and maintenance of the high temperatures required for operation may be provided by known solar thermal furnace techniques.

BRIEF DESCRIPTION OF THE DRAWINGS

Further features of the invention will be apparent from the following more detailed description taken in conjunction with the schematic drawing of an electrolytic cell configuration for separation of alkali oxides to simultaneously generate liquid alkali metal species and oxygen gas.

DESCRIPTION OF PREFERRED EMBODIMENTS

As shown schematically in the drawing, high temperature electrolytic cell 10 comprises cathode 11, alkali metal ion conducting molten salt electrolyte 12, oxygen vacancy conducting solid electrolyte 13, and oxygen anode 14. Anode current collector 15 and cathode current collector 16 are also provided in contact with their respective electrodes. Cell container 17 seals the cell from the atmosphere and preferably maintains constant, substantially atmospheric pressure. An inert gas such as argon may be circulated through the cell container to maintain substantially atmospheric pressures and prevent vaporization of the cell components.

Suitable cathodes 11 for use in the present invention may comprise low carbon steels, stainless steels, silicon, iron silicide ($FeSi_2$), lithiated iron silicides ($FeSi_2Li_x$) and other transition metal silicides. Under some electrolytic cell conditions, deposition of lithiated ferrous silicides may be prompted in situ by reaction of cathode 11 with molten salt electrolyte 12 at the cathode/electrolyte interface. Cathode 11 is preferably from about 5% to about 70% porous, and provides a suitable passage for the continuous removal of molten lithium by mechanical means or by capillary forces. Suitable cathode current collector 16 for use in the present invention may comprise low carbon 1010 steel, all stainless steels, Cr, Mn, Ni, Cu, and other electrochemically conductive metal alloys. Cathode 11 is in contact with molten salt electrolyte 12, and is preferably immersed in molten salt electrolyte 12. Cathode 11 is preferably provided with a surface coating comprising primarily $FeSi_2$ or Si which is converted during cell operation to a lithiated iron silicide $FeSi_2Li_{10}$ which facilitates deposition of unit activity lithium at the cathode/electrolyte interface.

Suitable alkali ion conducting molten salt electrolytes 12 include, but are not limited to the following: LiF-LiCl-$Li_2O$; $Li_2O$-$Na_2O$; $Li_2O$-$K_2O$-$CaMgSi_2O_6$; $Li_2O$-$K_2O$-$SiO_2$; $Li_2O$-$SiO_2$; and other molten salt electrolytes having low melting points of less than about 1000° C. and preferably from about 400° C. to about 900° C.; having high alkali ion conductivity; and capable of dissolving substantial amounts of $Li_2O$. LiF-LiCl-$Li_2O$ having an $Li_2O$ concentration of at least about 20 m/o is an especially preferred lithium ion conducting molten salt electrolyte.

Molten salt electrolyte 12 is contained by oxygen vacancy conducting solid electrolyte 13 having a high $O^{-2}$ conductivity at the high electrolytic cell operating temperatures. Suitable oxygen vacancy conducting solid electrolytes may comprise the following compounds: Binary $ZrO_2$ based materials having the general formulas $Zr_{1-x}M^{2+}O_{2-x}$ and $Zr_{1-x}M^{3+}O_{2-x/2}$, and ternary $ZrO_2$ based materials such as ZrO-$Y_2O_3$-$Ta_2O_5$, $ZrO_2$-$Yb_2O_3$-$MO_2$, and the like, where M=Ca, Mg, Y, La, Nd, Sm, Gd, Yb, Lu, Sc, Ho, and other materials having similar physical and chemical properties, and M comprises from about 5 m/o to about 20 m/o; $ThO_2$ based materials having the general formulas $Th_{1-x}M^{2+}O_{2-x}$ and $Th_{1-x}M^{3+}O_{2-x/2}$, where M=Ca, Y, Yb, Gd, La, and other materials having similar physical and chemical properties, and M comprises about 5m/o to 25 m/o; $CeO_2$ based materials having the general formulas $Ce_{1-x}M^{2+}O_{2-x}$ and $Ce_{1-x}M^{3+}O_{2-x/2}$, where M=Ca, Sr, Y, La, Nb, Sm, Eu, Gd, Dy, Ho, Er, Yb, and other materials having similar physical and chemical properties, and M comprises about 5 m/o to 20 m/o; δ-$Bi_2O_5$ based materials having the general formulas $Bi_{2-x}M^{2+}O_{3-x/2}$; $Bi_{2-x}M^{6+}O_{3-x/2}$; and $Bi_{2-x}M_x^{3+}O_3$, where M=Ca, Sr, W, Y, Gd, Dy, Er, Yb, Mo, Cr, and other materials having similar physical and chemical properties, and M comprises about 5 m/o to 35 m/o; $HfO_2$ based systems having the general formulas $Hf_{1-x}M^{2+}O_{2-x}$ and $Hf_{1-x}M^{3+}O_{2-x/2}$, where M—Ca, Sr, Y, and other materials having similar physical and chemical properties, and M comprises about 5 m/o to 35 m/o. Some suitable oxygen vacancy conducting solid electrolytes and their conductivities are as follows:

| | Conductivity ($ohm^{-1}cm^{-1}$) | Measurement Temp. T°C. |
|---|---|---|
| $ZrO_2$ (15 m/o CaO) | $2.4 \times 10^{-2}$ | 1000 |
| $ZrO_2$ (8 m/o $Y_2O_3$) | $5.6 \times 10^{-2}$ | 1000 |
| $ZrO_2$ (15–20 m/o MgO) | $(2–4) \times 10^{-2}$ | 1000 |
| $ZrO_2$ (5–15 m/o $La_2O_3$) | $(2.5–4) \times 10^{-3}$ | 1000 |
| $ZrO_2$ (15 m/o $Nd_2O_3$) | $(1.4–3.8) \times 10^{-2}$ | 1000 |
| $ZrO_2$ (10 m/o $Sm_2O_3$) | $5.8 \times 10^{-2}$ | 1000 |
| $ZrO_2$ (10 m/o $Gd_2O_3$) | $1.1 \times 10^{-1}$ | 1000 |
| $ZrO_2$ (9 m/o $Yb_2O_3$) | $1.5 \times 10^{-2}$ | 1000 |
| $ZrO_2$ (15 m/o $Lu_2O_3$) | $1.2 \times 10^{-2}$ | 1000 |
| $ZrO_2$ (10 m/o $Sc_2O_3$) | $2.4 \times 10^{-1}$ | 1000 |
| $ZrO_2$ (12.7 m/o $Ho_2O_3$) | $3.5 \times 10^{-2}$ | 880 |
| $ThO_2$ (7 m/o CaO) | $2 \times 10^{-3}$ | 1000 |
| $ThO_2$ (15 m/o $YO_{1.5}$) | $6.3 \times 10^{-3}$ | 1000 |
| $CeO_2$ (10 m/o CaO) | $\cong 10^{-1}$ | 1000 |
| $CeO_2$ (5 m/o $Y_2O_3$) | $\cong 0.8$ | 1000 |
| $Bi_2O_3$ (25 m/o $Y_2O_3$) | $\cong 0.3$ | 850 |
| $Bi_2O_3$ (28.5 m/o $Dy_2O_3$) | 0.14 | 700 |
| $Bi_2O_3$ (20 m/o $Er_2O_3$) | 1 | 800 |
| $Bi_2O_3$ (35 m/o $Yb_2O_3$) | 0.14 | 700 |
| $Bi_2O_3$ (35 m/o $Gd_2O_3$) | 0.22 | 700 |

oxygen vacancy conducting solid electrolyte 13 is in contact with anode 14, where oxygen gas evolution occurs. Anode 14 may comprise the following materials: perovskite-type materials having the general formula $LnMO_3$, where Ln=La or Pr, and M=Co, Ni, or Mn; compounds having the general formula $La_{1-x}Ma_xMbO_3$, where Ma=Sr, Ca, K or Pr and Mb=Cr, Mn, Fe, Co or Ba and x is from about 0.2 to 0.01; compounds having the general formula $LaMO_3$, where M=Ni, Co, Mn, Fe or V; and platinum. Anode 14 preferably comprises a thin electrode layer deposited on the outer surface of the oxygen vacancy conducting solid electrolyte. Suitable thin anode layers may be provided by techniques such as plasma spraying or slurry coating followed by sintering. Anode current collector 15 is preferably provided to collect current from anode 14, and may comprise platinum or other materials having high electronic conductivity at the high cell operating temperatures.

One especially preferred cell configuration according to this invention is provided with a stainless steel cathode immersed in molten salt electrolyte comprising LiF-LiCl-$Li_2O$, the $Li_2O$ concentration being at least about 20 m/o, the molten salt electrolyte contained by an oxygen vacancy conducting solid electrolyte comprising CaO(5 w/o)$ZrO_2$ with a thin anode layer comprising $La_{0.89}Sr_{0.10}MnO_3$ deposited on the outer surface of the solid electrolyte, and a platinum current collector contacting the anode.

Liquid lithium deposited at the cathode of electrolytic cell 10 may be continuously removed using mechanical means or techniques involving capillary attractive forces and may provide a continuous source of reducing agent for the direct thermochemical refining of lunar ores according to the reaction: $2Li+MO \rightarrow Li_2O+M$, where MO is lunar metal oxide ore. $Li_2O$ regenerated during thermochemical refining of lunar ores may be reintroduced into the catholyte compartment to complete the system cycle. Lithium oxide may thus be continuously removed from the lunar ore refining reaction and reintroduced into the electrolytic cell for electrochemical separation to liquid lithium and oxygen. According to a preferred embodiment, molten salt electrolyte 12 may be continuously circulated to maintain the desired concentration of $Li_2O$.

High temperature electrolytic cell 10 is illustrated in a tubular cell configuration, but the cell of the present invention may be conformed to a variety of battery geometries. Cell operating temperatures of from about 500° to about 900° C. are preferred, and maintenance of the high cell operating temperatures may be provided by means known to the art, such as muffle furnaces or solar thermal furnaces.

The following example sets forth specific cell components and their methods of manufacture and specific cell configurations for the purpose of more fully understanding preferred embodiments of the present invention and is not intended to limit the invention in any way.

EXAMPLE

A cell of the type shown in FIG. 1 was assembled by initially depositing the oxygen evolving anode in ethylene glycol/citric acid as a 5 w/o suspension of $La(C_2H_3O_2)$, $SrCO_3$ and $MnCO_3$ in ethylene glycol/citric acid having the appropriate composition to produce an anode comprising $La_{0.89}Sr_{0.10}MnO_3$ onto the outer surface of a calcia stabilized zirconia tube having a composition CaO(5 w/o)$ZrO_2$ with the dimensions 600 mm in length, 5 mm inner diameter and 8 mm outer diameter. A 0.25 mm platinum wire current collector was initially tightly coiled in this region. Decomposition of the electrocatalyst precursor was achieved by heating the tube assembly at 800° C. in air for one hour. This procedure was repeated three times, after which the anode half cell assembly was heated to 1250° C. for one hour to optimize the $La_{0.89}Sr_{.10}MnO_3$ morphology for oxygen gas evolution. Good adhesion was achieved between the finally sintered anode, the calcia stabilized zirconia tube and platinum current collector. Molten salt electrolyte had the following composition: LiF(28.5 m/o)-LiCl(66.5 m/o)-$Li_2O$(5 m/o) and possessed a conductivity between 1 and $5\Omega^{-1}cm^{-1}$ at 580° C. 304 stainless steel was used for the cathode with 3 $cm^2$ being immersed in the molten salt electrolyte. Current densities greater than 100 $mA/cm^2$ were achieved at temperatures of about 850° C. The total cell resistance between 650° and 900° C. decreased from about 18 to about 10Ω, the majority of which was attributed to the solid electrolyte. Upon passage of a galvanostatically controlled current through this cell, the volume of oxygen gas generated at the anode was Faradaic. The cell showed no evidence of performance degradation at 650 C. after over 100 hours of operation.

In separate half-cell measurements on this molten salt electrolyte using Fe wire electrodes, limiting current densities for lithium deposition of about 650 $mA/cm^2$ at 580° C. were found. Lithium deposition could be clearly seen to occur at the cathode when $FeSi_2$ was used as the electrode. Upon passage of cathodic charge a series of progressively more negative voltage plateaus were observed corresponding to formation of $FeSi_2Li_4$, $FeSi_2Li_6$, $FeSi_2Li_8$ and $FeSi_2Li_{10}$ respectively.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

I claim:

1. A high temperature electrolytic cell for electrochemical separation of alkali oxides to produce liquid alkali metal species comprising lithium and oxygen gas, said electrolytic cell comprising: a cathode; an alkali ion comprising lithium ion conducting molten salt electrolyte contacting said cathode; an oxygen vacancy conducting solid electrolyte contacting on one side said molten salt electrolyte; and an oxygen evolving anode contacting an opposite side of said oxygen vacancy conducting solid electrolyte.

2. A high temperature electrolytic cell according to claim 1 wherein said cathode is selected from the group consisting of: low carbon steels; stainless steels; silicon; iron silicides, and lithiated iron silicides; and other transition metal silicides.

3. A high temperature electrolytic cell according to claim 2 wherein said cathode additionally comprises a surface layer comprising primarily Si or $FeSi_2$ which is converted during cell operation to lithiated ferrous silicide $FeSi_2Li_{10}$.

4. A high temperature electrolytic cell according to claim 2 additionally comprising a current collector contacting said cathode, said current collector selected from the group consisting of: low carbon 1010 steel; stainless steels; Cr; Mn; Ni; Cu; and other electrochemically conductive metal alloys.

5. A high temperature electrolytic cell according to claim 2 wherein said alkali ion conducting molten salt electrolyte is selected from the group consisting of LiF-LiCl-$Li_2O$; $Li_2O$-$Na_2O$; $Li_2O$-$K_2O$-$CaMgSi_2O_6$; $Li_2O$-$K_2O$-$SiO_2$; and $Li_2O$-$SiO_2$.

6. A high temperature electrolytic cell according to claim 5 wherein $Li_2O$ is present in said alkali ion conducting molten salt electrolyte in a concentration of at least about 20 m/o.

7. A high temperature electrolytic cell according to claim 5 wherein said oxygen vacancy conducting solid electrolyte comprises a compound selected from the group consisting of: binary $ZrO_2$ based materials having the general formulas $Zr_{1-x}M^{2+}O_{2-x}$ and $Zr_{1-x}M^{3+}O_{2-x/2}$, and ternary $ZrO_2$ based materials such as $ZrO$-$Y_2O_3$-$Ta_2O_5$ and $ZrO_2$-$Yb_2O_3$-$MO_2$, where M=Ca, Mg, Y, La, Nd, Sm, Gd, Yb, Lu, Sc or Ho and M comprises about 5 m/o to about 20 m/o; $ThO_2$ based materials having the general formulas $Th_{1-x}M^{2+}O_{2-x}$ and $Th_{1-x}M^{3+}O_{2-x/2}$, where M=Ca, Y, Yb, Gd or La and M comprises about 5 m/o to about 25 m/o; $CeO_2$ based materials having the general formulas $Ce_{1-x}M^{2+}O_{2-x}$ and $Ce_{1-x}M^{3+}O_{2-x/2}$, where M=Ca, Sr, Y, La, Nb, Sm, Eu, Gd, Dy, Ho, Er or Yb and M comprises about 5 m/o to about 20 m/o; δ-$Bi_2O_5$ based materials having the general formulas $Bi_{2-x}M^{2+}O_{3-x/2}$; $Bi_{2-x}M^{6+}O_{3-x/2}$; and $Bi_{2-x}M_x^{3+}O_3$, where M=Ca, Sr, W, Y, Gd, Dy, Er, Yb, Mo, Cr, and M comprises about 5 m/o to about 35 m/o; and $HfO_2$ based systems having the general formulas $Hf_{1-x}M^{2+}O_{2-x}$ and $Hf_{1-x}M^{3+}O_{2-x/2}$, where M=Ca, Sr or Y and M comprises about 5 m/o to about 35 m/o.

8. A high temperature electrolytic cell according to claim 7 wherein said oxygen vacancy conducting solid electrolyte is a binary $ZrO_2$ based material.

9. A high temperature electrolytic cell according to claim 7 wherein said anode comprises a material selected from the group consisting of: perovskite-type materials having the general formula $LnMO_3$, where Ln=La or Pr, and M=Co, Ni, or Mn; compounds having the general formula $La_{1-x}M_axMbO_3$, where Ma=Sr, Ca, K or Pr and Mb=Cr, Mn, Fe, Co or Ba and x is from about 0.2 to about 0.01; compounds having the general formula $LaMO_3$, where M=Ni, Co, Mn, Fe or V; and platinum.

10. A high temperature electrolytic cell according to claim 9 additionally comprising a platinum current collector contacting said anode.

11. A high temperature electrolytic cell according to claim 9 additionally comprising a cell container enclosing and sealing said cathode, said molten salt electrolyte, said oxygen vacancy conducting solid electrolyte and said anode from the atmosphere in an interior volume, and providing maintenance of substantially atmospheric pressures in said interior volume.

12. A high temperature electrolytic cell according to claim 9 additionally comprising means for continuously removing a liquid alkali metal species from an interface of said cathode with said molten salt electrolyte.

13. A high temperature electrolytic cell according to claim 1 wherein said oxygen vacancy conducting solid electrolyte has a closed-end tubular configuration; said anode is deposited as a thin layer on the outer surface of said oxygen vacancy conducting solid electrolyte; said molten salt electrolyte is provided in an internal volume of said oxygen vacancy conducting solid electrolyte; and said cathode is immersed in said molten salt electrolyte.

14. A high temperature electrolytic cell according to claim 1 wherein said alkali species additionally comprises sodium.

15. A high temperature electrolytic cell according to claim 1 wherein said cathode comprises stainless steel; said molten salt electrolyte comprises LiF-LiCl-$Li_2O$; said oxygen vacancy conducting solid electrolyte comprises calcia stabilized zirconia; and said anode comprises $La_{0.89}Sr_{0.10}MnO_3$.

16. In a high temperature electrolytic cell for electrochemical separation of alkali oxides to produce liquid alkali metal species comprising lithium and oxygen gas of the type having a cathode in contact with a molten salt electrolyte for depositing of liquid alkali metal species comprising lithium and an anode facilitating evolution of oxygen gas, the improvement comprising: provision of an oxygen vacancy conducting solid electrolyte between and contacting both said anode and said molten salt electrolyte.

17. A high temperature electrolytic cell according to claim 16 wherein said oxygen vacancy conducting solid electrolyte comprises a compound selected from the group consisting of: binary $ZrO_2$ based materials having the general formulas $Zr_{1-x}M^{2+}O_{2-x}$ and $Zr_{1-x}M^{3+}O_{2-x/2}$, and ternary $ZrO_2$ based materials such as $ZrO$-$Y_2O_3$-$Ta_2O_5$ and $ZrO_2$-$Yb_2O_3$-$MO_2$, where M=Ca, Mg, Y, La, Nd, Sm, Gd, Yb, Lu, Sc or Ho and M comprises about 5 m/o to about 20 m/o; $ThO_2$ based materials having the general formulas $Th_{1-x}M^{2+}O_{2-x}$ and $Th_{1-x}M^{3+}O_{2-x/2}$, where M=Ca, Y, Yb, Gd or La and M comprises about 5 m/o to about 25 m/o; $CeO_2$ based materials having the general formulas $Ce_{1-x}M^{2+}O_{2-x}$ and $Ce_{1-x}M^{3+}O_{2-x/2}$, where M=Ca, Sr, Y, La, Nb, Sm, Eu, Gd, Dy, Ho, Er or Yb and M comprises about 5 m/o to about 20 m/o; $\delta$-$Bi_2O_5$ based materials having the general formulas $Bi_{2-x}M^{2+}O_{3-x/2}$; $Bi_{-x}M^{6+}O_{3-x/2}$; and $Bi_{2-x}M_x^{3+}O_3$, where M=Ca, Sr, W, Y, Gd, Dy, Er, Yb, Mo, Cr, V or Nb and M comprises about 5 m/o to about 35 m/o; and $HfO_2$ based systems having the general formulas $Hf_{1-x}M^{2+}O_{2-x}$ and $Hf_{1-x}M^{3+}O_{2-x/2}$, where M=Ca, Sr, or Y and M comprises about 5 m/o to about 35 m/o.

18. A high temperature electrolytic cell according to claim 17 wherein said oxygen vacancy conducting solid electrolyte comprises a binary zirconia based material.

* * * * *